US006285335B1

(12) United States Patent
Snygg et al.

(10) Patent No.: US 6,285,335 B1
(45) Date of Patent: Sep. 4, 2001

(54) METHOD OF MANUFACTURING AN ANTENNA STRUCTURE AND AN ANTENNA STRUCTURE MANUFACTURED ACCORDING TO THE SAID METHOD

(75) Inventors: Göran Snygg, Partille; Bengt Svensson, Mölndal; Sune Johansson, Växjö, all of (SE)

(73) Assignee: Telefonaktiebolaget LM Ericsson, Stockholm (SE)

( * ) Notice: Subject to any disclaimer, the term of this patent is extended or adjusted under 35 U.S.C. 154(b) by 0 days.

(21) Appl. No.: 09/310,171

(22) Filed: May 12, 1999

(30) Foreign Application Priority Data

May 12, 1998 (SE) ..... 9801667-8

(51) Int. Cl.[7] ..... H01Q 13/10
(52) U.S. Cl. ..... 343/770; 343/771; 343/772
(58) Field of Search ..... 343/770, 778, 343/772, 776, 786, 774, 789, 767, 768, 771; H01Q 13/10

(56) References Cited

U.S. PATENT DOCUMENTS 3,914,861 * 10/1975 Phillips ..... 343/786
3,925,883 12/1975 Cavalear ..... 29/600
5,426,442 * 6/1995 Haas ..... 343/786
5,541,612 * 7/1996 Josefsson ..... 343/771
5,568,160 * 10/1996 Collins ..... 343/786

* cited by examiner

*Primary Examiner*—Hoanganh Le
(74) *Attorney, Agent, or Firm*—Burns, Doane, Swecker & Mathis, L.L.P.

(57) ABSTRACT

An antenna structure for the transmission and processing of electromagnetic microwave signals is manufactured by making holes in a number of electrically-conductive plates by a mechanical or chemical process in order to create cut-outs in the form of through holes with electrically-conductive edge surfaces. For each plate, the holes have a defined position and length from one side of each plate to its other side. The plates with the holes are stacked in a defined relative position, and the sides of the plates are fixed to each other at least around the edge surfaces formed. In this way, a number of holes are given electrically-conductively limited surfaces in the form of the edge surfaces and also the parts of the side surfaces of the surrounding plate facing the holes.

19 Claims, 6 Drawing Sheets

METHOD OF MANUFACTURING AN ANTENNA STRUCTURE AND AN ANTENNA STRUCTURE MANUFACTURED ACCORDING TO THE SAID METHOD

This application claims priority under 35 U.S.C. §§119 and/or 365 to 9801667-8 filed in Sweden on May 12, 1998; the entire content of which is hereby incorporated by reference.

BACKGROUND

This invention relates to a method of manufacturing an antenna structure for the transmission and processing of electromagnetic microwave signals.

This invention also relates to an antenna structure comprising a distribution network for the transmission and processing of electromagnetic microwave signals. The antenna structure is constructed as a plate structure, in which there are cut-outs and which comprises at least one intermediate electrically-conductive plate with surrounding electrically-conductive plates attached on each side of each intermediate plate. Each side of these surrounding plates is in contact with one or the other side of each intermediate plate.

The most commonly used antenna structure for microwave signals is the reflector antenna with a three-dimensionally curved reflector, normally in the shape of a parabola, with a feeder situated at the focus. However, this type of antenna takes up a lot of room, particularly on account of its large depth in relation to its height.

Within wireless information transmission, e.g. within radio link communication, ever-increasing demands are being made for thin plate structures, which are able to fit more easily into the surroundings.

Previously flat conductor antenna have been produced based upon microstrip technology which, although it is flat, involves large losses and can lead to complicated solutions, particularly for high frequencies.

U.S. Pat. No. 3,925,883 shows a wave guide device which is formed by bending a metal plate and fixing it to other plates. A component of the wave guide device can be constructed of a plate structure with a number of plates with holes laid on each other which form a microwave flange. The holes in the plates have, however, relatively similar configuration whereby a hole in an intermediate plate is not limited to any significant degree by the surrounding plates, which thereby cannot form any wave guide structure in the principal plane of the plates. The wave conductor device is not an antenna structure.

A wave guide device which is constructed as a plate structure is known from SWEDISH PATENT DOCUMENT SE-C2-505 504. This device has a base plate in which wave conductors and wave conductor components are cut out. In this device only one surrounding plate forms the limit surface for one and the same hole. Nor does this wave guide device consist of an antenna structure.

SUMMARY

The aim of this invention is to produce an antenna structure using a simple construction technique, even in those cases where a complicated structure is to be produced.

This aim is achieved by means of a method and an antenna structure according to this invention. The method comprises making holes in at least three electrically-conductive plates by a mechanical or chemical process in order to create cut-outs in the form of through holes with electrically-conductive edge surfaces. These have a defined position and length on each plate's principal plane and also a length from one side of each plate to its other side. The method also comprises stacking the plates with the holes in a defined relative position and electrically-conductive fixing together of the sides of the plates to each other at least around the edge surfaces formed. In this way a number of holes are given electrically-conductive limit surfaces in the form of the edge surfaces and also the parts of the side surfaces of the surrounding plates facing the holes. The cut-outs in the antenna structure are made up of through holes with electrically-conductive edge surfaces which form first limit surfaces in each hole. These extend in the principal plane of each plate with a defined position and length for each plate and extend from one side of each plate to its other side. At least two of the surrounding plates form with parts of their side surfaces facing the holes in an intermediate plate second limit surfaces for the said holes in at least one intermediate plate.

Complicated structures can also be manufactured by the method and the antenna structure according to the invention with an extremely rational, cost-saving manufacturing technique whereby each plate is provided with through holes and certain surrounding plate surfaces form limit surfaces for the intermediate plate or plates.

BRIEF DESCRIPTION OF THE FIGURES

In the following the invention will be described in greater detail utilizing examples of preferred embodiments and with reference to the attached figures, where.

DETAILED DESCRIPTION

Figure 1:
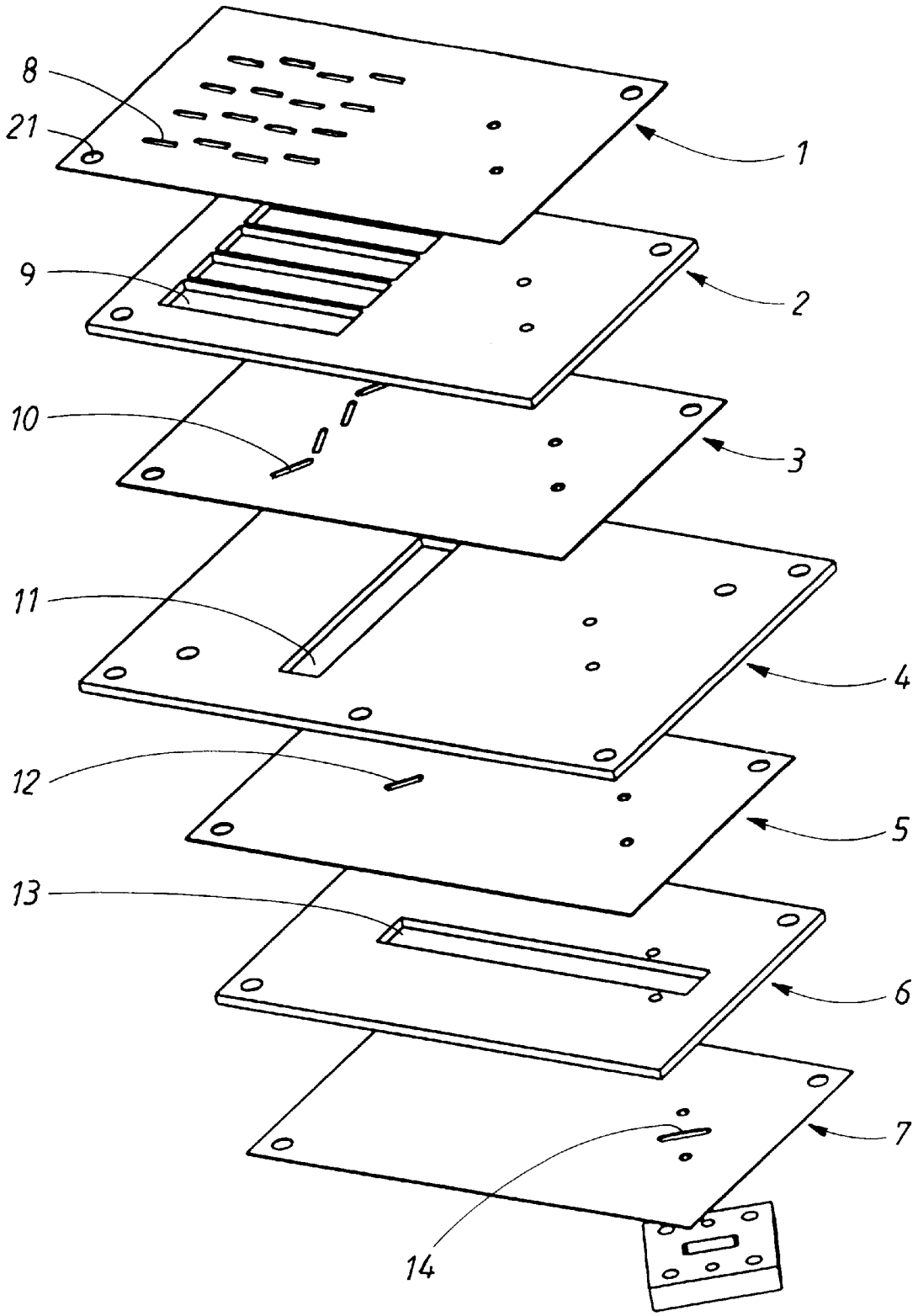
FIG. 1 shows an exploded view or the antenna structure according to the invention in a first embodiment.
Figure 2:
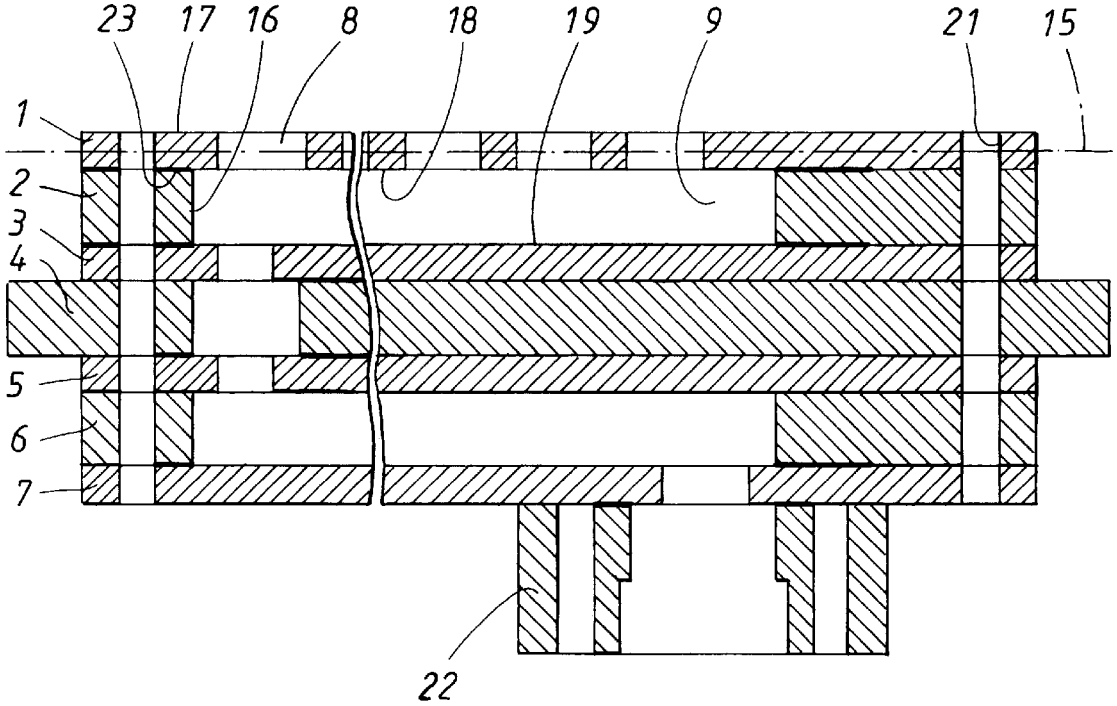
FIG. 2 shows a cross section of the assembled antenna structure.

As shown by the embodiment according to FIG. 1 the antenna structure according to the invention is composed of a plate structure, which for the sake of clarity is shown in perspective as an exploded view. The plate structure consists of a number of plates 1–7 which are intended to be stacked on each other as shown in FIG. 2. Each plate has one or more cut-outs 8–14 in the form of through holes or cavities. One or more of the plates are provided with holes in the form of wave guides, such as 9, 11, 13 while one or more of the other plates 1, 3, 5, 7 have holes in the form of radiation apertures, such as hole 8 in the first plate 1, or connection apertures such as cavities 10, 12, 14 in the plates 3, 5 and 7. The radiation apertures act as antenna elements, while the connection apertures connect the power between the different layers or plates. The thickness or height of certain of the plates, such as plates 2, 4, 6 containing the wave guides 9, 11, 13 is dimensioned to provide good conditions for the electromagnetic microwave signal which is to be transmitted through the wave guides. The height of the plates 2, 4, 6 thus determines the height of the wave guides. The plate height can be the same as the height of the wave guide as in the example shown, or alternatively two or more plates with identical cavities, i.e. cavities which are congruent and in the same position, can be put together in order to construct wave guide cavities. In the plates 3, 5 with connection apertures, for example in the form of slits, the thickness can be considerably less.

The plates can be constructed of solid metal, conductive non-metallic material, in the form of a non-conductive core with a conductive outer layer, etc. The cavities 8–14 are produced by a mechanical or chemical process, such as a cutting process, for example punching, laser cutting, hydraulic cutting, milling or etching (chemical) or the like, giving low manufacturing costs. These types of process provide in each plate a first type of limit surface for each cavities which extends transverse to each plate's principal plane 15 in the form of a edge surface 16 extending around the cavities 8–14 which extends from one side 17, 19 of plate 1–7 to its other side 18, in the example shown at right angles to these sides. In the example shown the plates are rectangular or more accurately right-angled parallelepipeds with little thickness or height in relation to the width and length. The plates can, however, have other proportions or other shapes, for example they can be round, e.g. circular. The sides 17, 18, 19 of each plate are parallel to each other and mainly flat. The edge surfaces 16 and hence the cavities 8–14 have a specific position and length or configuration for most of the plates. The antenna structure is provided with a feeding network or distribution network for feeding to or from a combination of parallel-fed and series-fed radiation elements, whereby all the cavities communicate with each other directly or indirectly. The antenna structure is reciprocal, i.e. it can be used for both the transmission and reception of microwaves.

When the plates 1–7 are constructed in certain materials such as aluminium or polymer, these can advantageously be surface-treated, for example with silver, at least on sides 18, 19 which are to be fixed together, so that the fixing agent such as glue or solder will adhere.

According to the invention the plates 1–7 are fixed together in such a way that a good electricallyconductive joint 23 is obtained between the adjacent plates. This joint can for example be made by the application of solder around the intended cavity before the plates are placed together, that is stacked on each other with the sides of plates in contact with each other, after which the assembled plate structure is placed in a soldering furnace to make the solder adhere to the metal in the plates. The fixing together can be carried out in other ways which provide electrically-conductive joints, such as films of adhesive with a high metal content or thin metal layers without flux which are Melted between the plates.

By means of the assembly of the plates the final limitation of the cavities is determined by the specific position and length, i.e. the configuration of the cavities 8–14. As is shown most clearly in FIG. 2 the adjacent sides 18, 19 in the plates which enclose an intermediate plate, for example plates 1 and 3 which enclose plate 2, form another type of limit surface for the hole 9 in the intermediate plate 2 which is thus limited by the edge surfaces 16 and also by parts of the side surfaces of the surrounding plates. The position of the plates in relation to each other is ensured during the manufacturing process by means of guides, for example guide pins in hole 21.

In addition to the principally equally-sized plates in the example there is a connection piece 22 for communication with other components in a completed device, for example a microwave transmitter or receiver.

Figure 3:
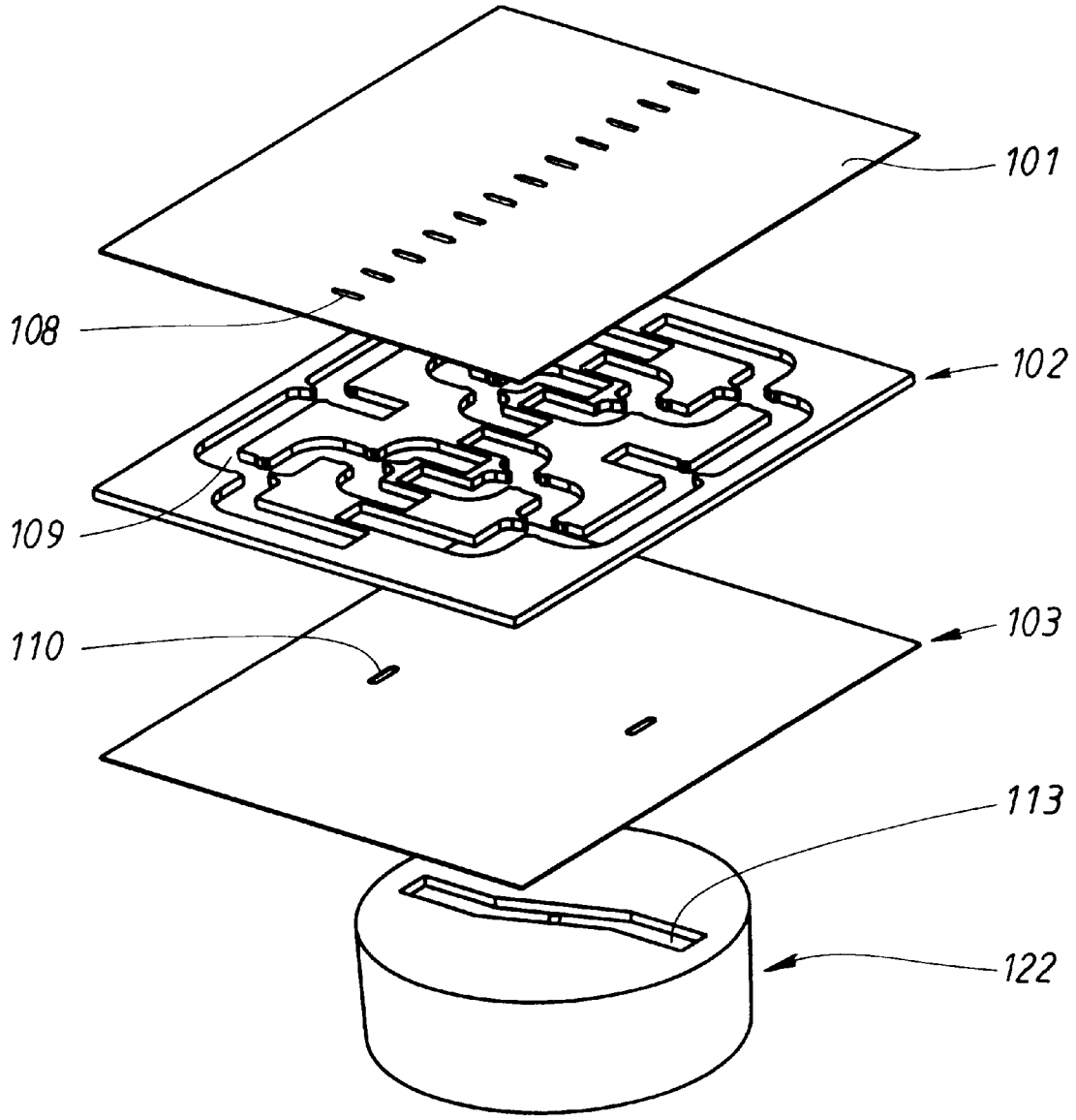
FIG. 3 shows an exploded view of the antenna structure according to the invention in a second embodiment.

FIG. 3 shows a second example of an antenna structure with a refined parallel feed of a number of radiation apertures 108. In addition to a connection piece 122 with a first distribution wave guide 113 there are three plates 101, 102, 103 where the first plate 103 contains feed apertures 110 and the second plate 102 contains a number of branched distribution wave conductors 109 corresponding to the number of feed apertures 110, which branched distribution wave conductors 109 in turn feed all the radiation apertures 101.

The method of manufacturing the wave guide device can thus be summarized as follows. A number of plates are processed mechanically or chemically, for example by a hole-cutting process, in order to create cut-outs in the form of through holes which have a selected position and configuration for each plate. The plates with the holes are stacked in a combined defined relative position and fixed together by means of an electrically-conductive fixing agent, at least around the holes on all or parts of the surfaces of the plates, whereby the holes are finally defined by their limit surfaces forming the final cavities. This ensures that all the surfaces in the cavities, i.e. also the edge surfaces 16, are electrically-conductive surfaces, forming in each cavity a continuous or closed electrically conductive surface.

Figure 4:
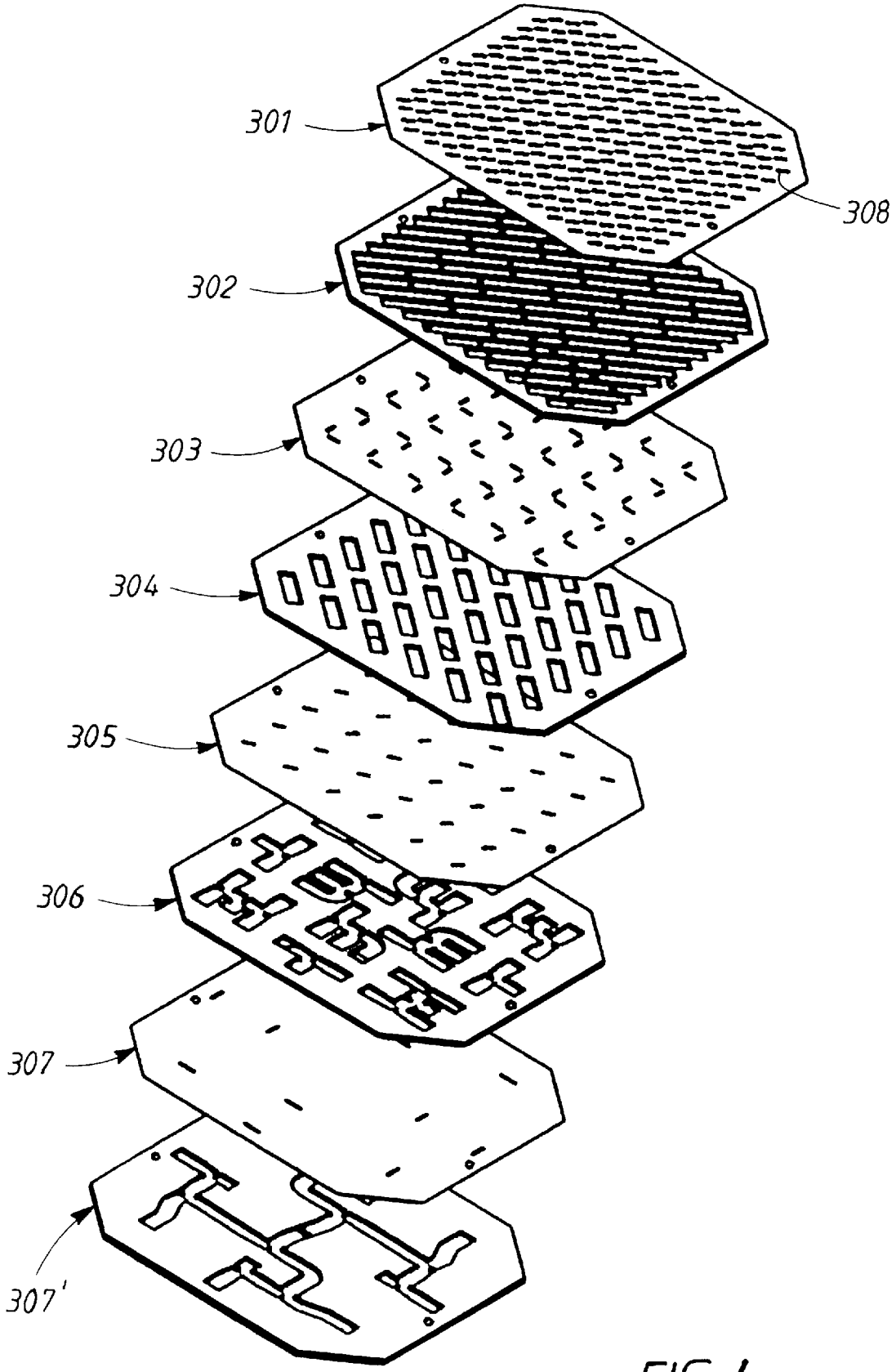
FIG. 4 shows an exploded view of the antenna structure according to the invention in a third embodiment.
Figure 5:
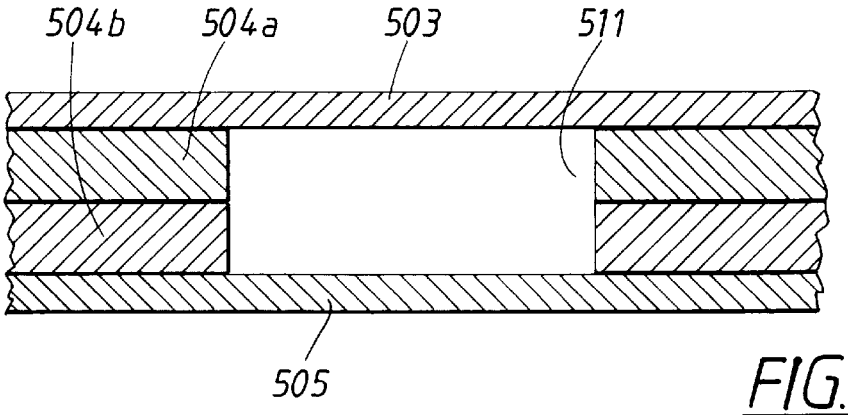
FIGS. 5–9 show some cross sections of different variants of the assembly technique for the antenna structure according to the invention.
Figure 6:
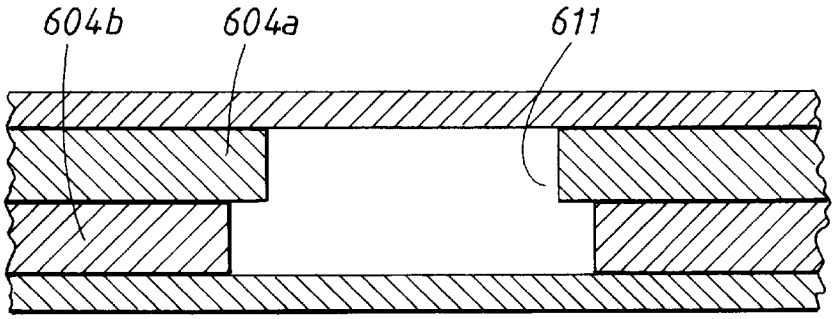

FIG. 4 shows an example of an antenna structure with greater complexity with a number of levels of parallel distribution networks in the form of a combination of aperture plates 301, 303, 305, 307 and wave guide plates 302, 304, 306, 307'. Using a very compact construction this provides a high-grade distribution of the microwave signal to a very large number of radiation apertures 308 which form the antenna element in the outer aperture plate 301.

Figure 7:
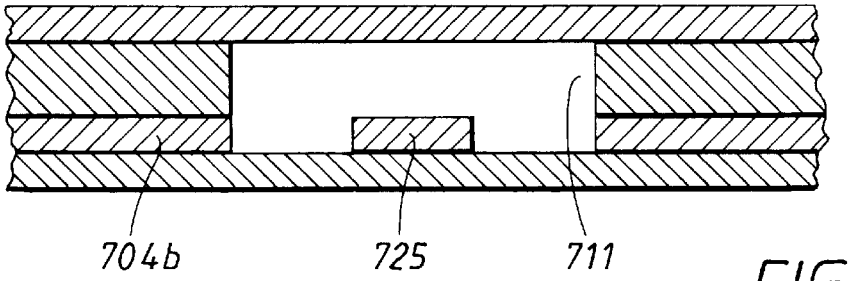
Figure 8:
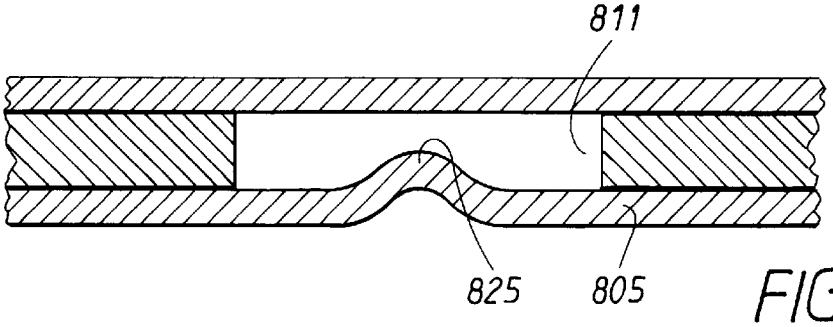
Figure 9:
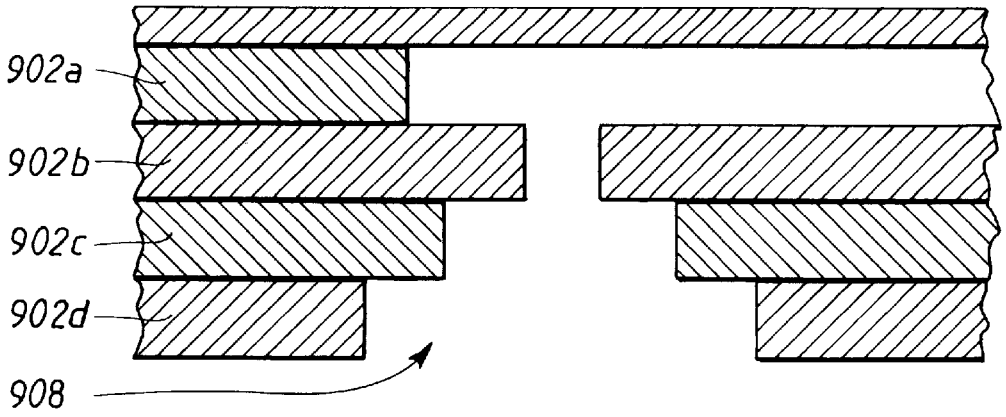

FIGS. 5–9 show various examples of the construction of different wave guides 511, 611, 711, 811, 911 and a radiation aperture 908. In the embodiment according to FIG. 5 the wave guide 511 is constructed of two wave guide plates 504*a*, 504*b* with at least in cross section identical cut-outs and two surrounding plates 503, 505. The wave guide 611 is similarly constructed Qf two wave guide plates 604*a*, 604*b* in which, however, the cut-outs are not identical but provide a wave guide with a greater breadth at its base. The wave guide 711 according to FIG. 7 is constructed as a so-called "ridge" wave guide with a protruding part 725 which can extend over all or parts of the length of the wave guide transverse to the plane of the paper. The protruding part can be formed, for example, from a part of the wave guide plate 704*b*. In FIG. 8 the wave guide 811 is similarly a "ridge" type wave guide, where the protruding part 825 is formed by a local deformation of one of the surrounding plates 805. In a similar way reflection adjustment or other changes to the transmission characteristics of the wave conductor can be carried out by means of local deformations in some of the plates. In FIG. 9 the radiation aperture 908 is cone-shaped, formed by a number of wave guide plates 902*a*, 902*b*, 902*c*, 902*d* with aligned cut-outs increasing in size in steps so that the opening of the aperture widens in the direction outwards from the antenna structure.

Figure 10:
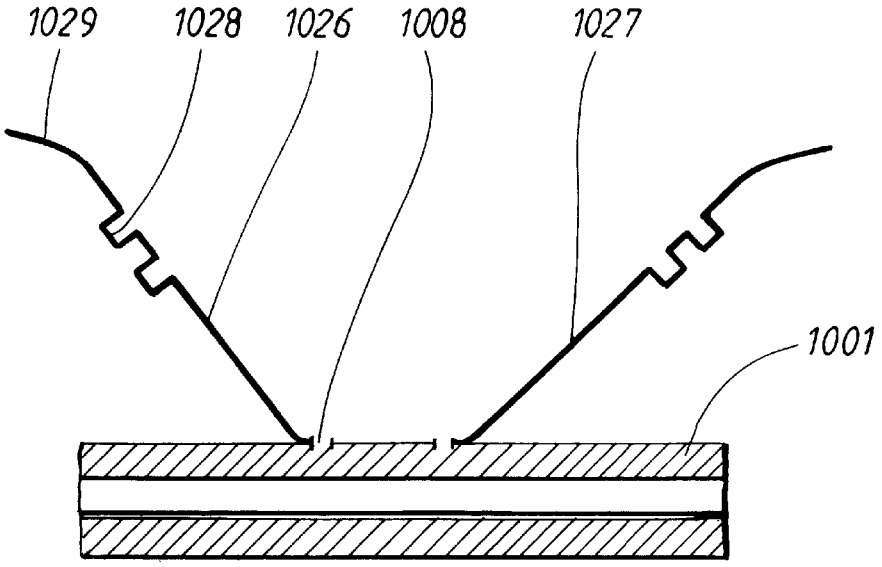
FIG. 10 shows a cross section of an example of an antenna structure fitted with baffles.

FIG. 10 shows an example of an antenna structure with baffles 1026, 1027 positioned at the radiation apertures 1008 in the aperture plate 1001 which is the outer plate in the structure. This consists of a number of wave guide plates and intermediate aperture plates which can have the same construction as any of the antenna structures described above. For the sake of simplicity, however, holes are not shown in FIG. 10 with the exception of the radiation apertures 1008 in the outer plate. In the example shown the baffles are constructed of angled metal plates of electrically-conductive material or at least with an electrically-conductive surface, which affects the radiation characteristics of the antenna. Unwanted edge phenomena can be counteracted or the form of the beam can be changed by specially shaped parts 1028 such as corrugations, or turned outwards edge parts 1029.

By the method of construction described above it is thus possible to produce very complicated antenna structures which can be used to improve the bandwidth and/or to increase the options in the incorporated feed network. For example the slits in slit wave guide antennas can be parallel fed with considerably better bandwidth being achieved as a result. By parallel feed instead of refined series feed there is a greater opportunity to select different excitations, giving varying amplitude and/or phase for the different slits. By using this the radiation characteristics of the antenna can be affected to a greater degree than was previously possible. This can be used to reduce the side beam level, widen the beam and even to give the beam the form required. In addition this method of construction provides low cross polarisation.

An additional advantage of the method of construction according to the invention is obtained when manufacturing a vertical polarized antenna in that instead of so-called edge slits, shared parallel slits can be used, for example longitudinal slits, which means that considerably better cross-polarization properties can be obtained.

The antenna structure according to the present invention forms a wave guide structure, i.e. having a cross-section with a continuous or closed contour, forming a continuous or closed electrically conductive surface, defining a substantially non-conductive space, forming a cavity, without any further electrical conductor being included. Such cavities can include air or other kind of gas, but can also be completely or partly filled with substantially non-conductive material.

This invention is not limited to the embodiments described above and shown in the figures, but can be varied within the framework of the following patent claims. For example, the plates can be in different numbers and combinations, such as three, four, five plates or more. For example, the plates can have different dimensions. In addition the configuration and position of the holes can be selected to be very different.

The antenna structure is suitable for a number of applications, such as radio link antennas, robot target seeker antennas, radar antennas, antennas for satellite communication. Thanks to its discrete shape the solution is particularly suitable for use in environments where there are requirements that the antenna must fit into the surroundings. Cavities in the form of apertures and wave guides can be given very varying forms and proportions. For example, an electrically-isolating plate can be provided with an electrically-conductive layer with apertures, the edge parts of which have very little height.

What is claimed is:

1. Method of manufacturing an antenna structure for transmission and processing of electromagnetic microwave signals, said method comprising the steps of a) making holes in at least three electrically-conductive plates, thereby creating cut-outs in the form of through holes with electrically-conductive edge surfaces which for each plate have a defined position and length in each plate's principal plane and also a length from one side of each plate to its other side b) stacking the plates with the holes in a defined relative position and electrically-conductivity fixing the sides of the plates to each other at least around the edge surfaces formed, whereby a number of the holes form cavities which are given electrically-conductive limited surfaces in the form of the edge surfaces and also the parts of the side surfaces of the surrounding plates facing the cavities.

2. The method according to claim 1, wherein said cavities form wave guides thereof a continuous, electrically conductive surface defines each cavity.

3. The method according to claim 1, further comprising the surface treating the plates on at least the side surfaces which are to be assembled and fixing together by applying a fixing agent on at least one side surface of certain plates.

4. The method according to claim 3, wherein the fixing together is carried out by applying solder.

5. The method according to claim 3, wherein the fixing together is carried out by applying glue.

6. An antenna structure comprising a distribution network for transmission and processing of electromagnetic microwave signals, constructed as a plate structure, in which cut-outs are arranged and which including at least one intermediate electrically-conductive plate with surrounding electrically-conductive plates situated on each side of each intermediate plate, with each side of the surrounding plates in contact with one side or the other side of each intermediate plate, wherein the cut-outs comprise through holes forming cavities with electrically-conductive edge surfaces which form first limiting surfaces in each hole, which extend in each plate's principal plane with a defined position and length for each plate and also extend from one side of each plate to its other side and wherein at least two of the surrounding plates with parts of their side surfaces facing the cavities in an intermediate plate, form second limiting surfaces for the cavities in at least one intermediate plate.

7. The antenna structure according to claim 6, wherein said cavities form wave guides and a continuous, electrically conductive surface, defines each cavity.

8. The antenna structure according to claim 6, wherein the cavities comprise apertures and wave conductors.

9. The antenna structure according to claim 8, wherein one or more of the plates are provided with cavities only of an aperture type and the other plates are provided with cavities only of a wave guide type.

10. The antenna structure according to claim 9, wherein at least both outer plates have cavities only of the aperture type.

11. The antenna structure according to claim 10, wherein one of the outer plates has apertures in the form of radiation elements.

12. The antenna structure according to claim 11, wherein the radiation apertures are enclosed by baffles which are positioned at an angle to the outer plate in order to affect the antenna characteristics.

13. The antenna structure according to claim 11, wherein the antenna structure comprises a distribution network for parallel feeding of microwave signals to the radiation apertures.

14. The antenna structure according to claim 13, wherein the antenna structure gives a single-polarized emission of microwave signals from the radiation apertures.

15. The antenna structure according to claim 8, wherein one or more of the wave guides are formed by cavities in two or more of the stacked plates.

16. The antenna structure according to claim 6, wherein at least one of the cavities has a protruding part which gives the hole the character of a "ridge" wave guide.

17. The antenna structure according to claim 6, wherein at least one of the cavities has a locally protruding part for changing the transmission characteristics.

18. The antenna structure according to claim 11, wherein said radiation apertures include two or more cavities.

19. An antenna structure comprising a distribution network for transmission and processing of electromagnetic microwave signals, constructed as a plate structure, in which cut-outs are arranged and which includes at least one intermediate electrically-conductive plate with surrounding electrically-conductive plates situated on each side of each intermediate plate, with each side of the surrounding plates in contact with one side or the other side of each intermediate plate, wherein the cut-outs comprise through holes forming cavities with electrically-conductive edge surfaces which form first limiting surfaces in each hole, which extend in each plate's principal plane with a defined position and length for each plate and also extend from one side of each plate to its other side and wherein at least two of the surrounding plates with parts of the side surfaces facing the cavities in an intermediate plate, form second limiting surfaces for the cavities in at least one intermediate plate, wherein the cavities comprise apertures and wave conductors, and wherein the plates are five or more in number.

* * * * *